US011346205B2

(12) United States Patent
Kalia et al.

(10) Patent No.: US 11,346,205 B2
(45) **Date of Patent: *May 31, 2022**

(54) LOAD AND VIBRATION MONITORING ON A FLOWLINE JUMPER

(71) Applicant: OneSubsea IP UK Limited, London (GB)

(72) Inventors: Akshay Kalia, Houston, TX (US); Marcus Lara, Cypress, TX (US); Alireza Shirani, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/368,302

(22) Filed: Dec. 2, 2016

(65) Prior Publication Data

US 2018/0156026 A1 Jun. 7, 2018

(51) Int. Cl.

| | |
|---|---|
| ***E21B 47/00*** | (2012.01) |
| ***E21B 47/007*** | (2012.01) |
| ***E21B 43/017*** | (2006.01) |
| ***E21B 17/00*** | (2006.01) |
| ***E21B 33/038*** | (2006.01) |
| ***E21B 43/013*** | (2006.01) |

(52) U.S. Cl.

CPC ..... *E21B 47/007* (2020.05); *E21B 17/006* (2013.01); *E21B 33/038* (2013.01); *E21B 43/013* (2013.01); *E21B 43/017* (2013.01)

(58) Field of Classification Search

CPC .... E21B 17/006; E21B 33/038; E21B 43/013; E21B 43/017; E21B 47/0006; E21B 47/007

See application file for complete search history.

(56) References Cited

U.S. PATENT DOCUMENTS

| | | | |
|---|---|---|---|
| 3,373,807 | A | 3/1968 | Fischer et al. |
| 3,523,579 | A | 8/1970 | Nelson |
| 4,225,160 | A | 9/1980 | Ortloff |
| 4,232,547 | A | 11/1980 | Kasper |
| 4,290,311 | A | 9/1981 | Brewer |

(Continued)

FOREIGN PATENT DOCUMENTS

| | | | |
|---|---|---|---|
| DE | 3636252 | C1 | 10/1988 |
| EP | 1832798 | A1 | 9/2007 |

(Continued)

OTHER PUBLICATIONS

Extended European Search Report issued in European Patent Appl. No. 17204152.7 dated Apr. 25, 2018; 9 pages.

(Continued)

*Primary Examiner* — Christopher J Sebesta
(74) *Attorney, Agent, or Firm* — Eileen Pape

(57) ABSTRACT

A flowline jumper for providing fluid communication between first and second spaced apart subsea structures includes a length of conduit having a predetermined size and shape and first and second connectors deployed on opposing ends of the conduit. The first and second connectors are configured to couple with corresponding connectors on the subsea structures. At least one electronic sensor is deployed on the conduit. The sensor is configured to measure at least one of a vibration and a load in the conduit.

16 Claims, 3 Drawing Sheets

(56) References Cited

U.S. PATENT DOCUMENTS

| | | | | |
|---|---|---|---|---|
| 5,320,175 | A | 6/1994 | Ritter et al. | |
| 6,257,162 | B1 | 7/2001 | Watt et al. | |
| 6,481,504 | B1 | 11/2002 | Gatherar | |
| 6,663,453 | B2 | 12/2003 | Quigley et al. | |
| 6,700,835 | B1 | 3/2004 | Ward et al. | |
| 7,044,228 | B2 | 5/2006 | Langford et al. | |
| 7,565,931 | B2 | 7/2009 | Saucier | |
| 8,555,978 | B2 | 10/2013 | Ganelin et al. | |
| 8,857,519 | B2 | 10/2014 | Hale | |
| 8,950,497 | B2 | 2/2015 | Critsinelis et al. | |
| 9,181,942 | B2 | 11/2015 | Batho et al. | |
| 9,214,816 | B2 | 12/2015 | Batho et al. | |
| 9,534,452 | B2 | 1/2017 | Hatton | |
| 9,534,453 | B2 | 1/2017 | Machin et al. | |
| 9,657,525 | B2 | 5/2017 | Ray et al. | |
| 2003/0008577 | A1* | 1/2003 | Quigley | B32B 1/08 441/133 |
| 2003/0145997 | A1 | 8/2003 | Langford et al. | |
| 2003/0145998 | A1* | 8/2003 | Langford | B01D 17/0211 166/350 |
| 2006/0118308 | A1 | 6/2006 | Saucier | |
| 2009/0133612 | A1* | 5/2009 | Wajnikonis | B63B 21/502 114/199 |
| 2010/0288503 | A1 | 11/2010 | Cuiper et al. | |
| 2011/0042934 | A1 | 2/2011 | Morck | |
| 2011/0139460 | A1* | 6/2011 | Selstad | E21B 43/01 166/344 |
| 2011/0297389 | A1 | 12/2011 | McKay | |
| 2012/0107050 | A1 | 5/2012 | Wolbers et al. | |
| 2012/0152559 | A1* | 6/2012 | Knox | C23F 13/04 166/345 |
| 2012/0192982 | A1 | 8/2012 | Roberts et al. | |
| 2012/0275274 | A1 | 11/2012 | Gochnour et al. | |
| 2012/0294114 | A1 | 11/2012 | Gochnour et al. | |
| 2013/0043035 | A1 | 2/2013 | Hale | |
| 2013/0118249 | A1* | 5/2013 | Conn | E21B 47/18 73/152.21 |
| 2013/0292129 | A1 | 11/2013 | Tan et al. | |
| 2014/0299328 | A1* | 10/2014 | Ray | E21B 33/035 166/358 |
| 2015/0096758 | A1* | 4/2015 | Babbitt | E21B 33/064 166/335 |
| 2015/0219508 | A1* | 8/2015 | Bryant | G01L 5/165 73/152.59 |
| 2015/0226352 | A1 | 8/2015 | Oyen et al. | |
| 2016/0044390 | A1 | 2/2016 | Hunter et al. | |
| 2016/0160630 | A1* | 6/2016 | Flight | E21B 17/01 166/336 |
| 2016/0273694 | A1 | 9/2016 | Cox et al. | |
| 2016/0340988 | A1 | 11/2016 | Abou-Assaad et al. | |
| 2016/0362956 | A1 | 12/2016 | Older et al. | |
| 2018/0156024 | A1 | 6/2018 | Coble et al. | |

FOREIGN PATENT DOCUMENTS

| | | | |
|---|---|---|---|
| GB | 2456831 | A | 7/2009 |
| GB | 2457278 | A | 8/2009 |
| WO | 2006050488 | A1 | 5/2006 |
| WO | 2009109747 | A1 | 9/2009 |
| WO | 2011119479 | A1 | 9/2011 |

OTHER PUBLICATIONS

Extended European Search Report issued in European Patent Appl. No. 17204188.1 dated Jun. 28, 2018; 8 pages.

3rd Party Observations Communication Pursuant to Rule 114(2) EPC, issued in related European Patent Application No. 17204152.7 dated Sep. 20, 2019, 5 pages.

API Recommended Practice 17R, "Recommended Practice for Flowline Connectors and Jumpers", American Petroleum Institute, Mar. 2015, 60 pages.

Communication pursuant to Article 94(3) EPC received in European Patent Application No. 17204152.7 dated Dec. 16, 2019, 4 pages.

Extended European Search Report issued in European Patent Application No. 21153265.0 dated Apr. 8, 2021.

* cited by examiner

LOAD AND VIBRATION MONITORING ON A FLOWLINE JUMPER

CROSS REFERENCE TO RELATED APPLICATIONS

None.

FIELD OF THE INVENTION

Disclosed embodiments relate generally to subsea flowline jumpers and more particularly to an apparatus and method for monitoring load and vibration on a flowline jumper during installation and/or production operations.

BACKGROUND INFORMATION

Flowline jumpers are used in subsea hydrocarbon production operations to provide fluid communication between two subsea structures located on the sea floor. For example, a flowline jumper may be used to connect a subsea manifold to a subsea tree deployed over an offshore well and may thus be used to transport wellbore fluids from the well to the manifold. As such a flowline jumper generally includes a length of conduit with connectors located at each end of the conduit. Clamp style and collet style connectors are commonly utilized and are configured to mate with corresponding hubs on the subsea structures. As is known in the art, these connectors may be oriented vertically or horizontally with respect to the sea floor (the disclosed embodiments are not limited in this regard).

Subsea installations are time consuming and very expensive. The flowline jumpers and the corresponding connectors must therefore be highly reliable and durable. Flowline jumpers can be subject to large static and dynamic (e.g., vibrational) loads during installation and routine use. These loads may damage and/or fatigue the conduit and/or connectors in the flowline jumper and may compromise the integrity of the fluid connection. There is a need in the art for improved flowline jumper technology that enables maximum production flow without jeopardizing jumper integrity.

SUMMARY

A flowline jumper is configured for providing fluid communication between first and second spaced apart subsea structures. The flowline jumper includes a length of conduit having a predetermined size and shape and first and second connectors deployed on opposing ends of the conduit. The first and second connectors are configured to couple with corresponding connectors on the subsea structures. At least one electronic sensor is deployed on the conduit. The sensor is configured to measure at least one of a vibration and a load in the conduit.

A hydrocarbon production method includes producing wellbore fluids through a subsea flowline jumper at a controlled flow rate. The flowline jumper provides a fluid passageway for the wellbore fluid between first and second subsea structures. A sensor deployed on the flowline jumper measures at least one of a vibration and a load in the jumper. The sensor measurement is transmitted to a control system at a surface location evaluated against a predetermined threshold. The flow rate is maintained when the sensor measurement is less than a predetermined threshold and reduced when the sensor measurement is greater than a predetermined threshold.

The disclosed embodiments may provide various technical advantages. For example, certain of the disclosed embodiments may provide for more reliable and less time consuming jumper installation. For example, available sensor data from the flowline jumper(s) may improve first pass installation success. The disclosed embodiments may further enable the state of the flowline jumper to be monitored during jumper installation and production operations via providing sensor data to the surface. Such data may provide greater understanding of the system response and performance and may also decrease or even obviate the need for post installation testing. The sensor data may also indicate the presence of potentially damaging vibrational conditions such as flow induced vibration and vortex induced vibration.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
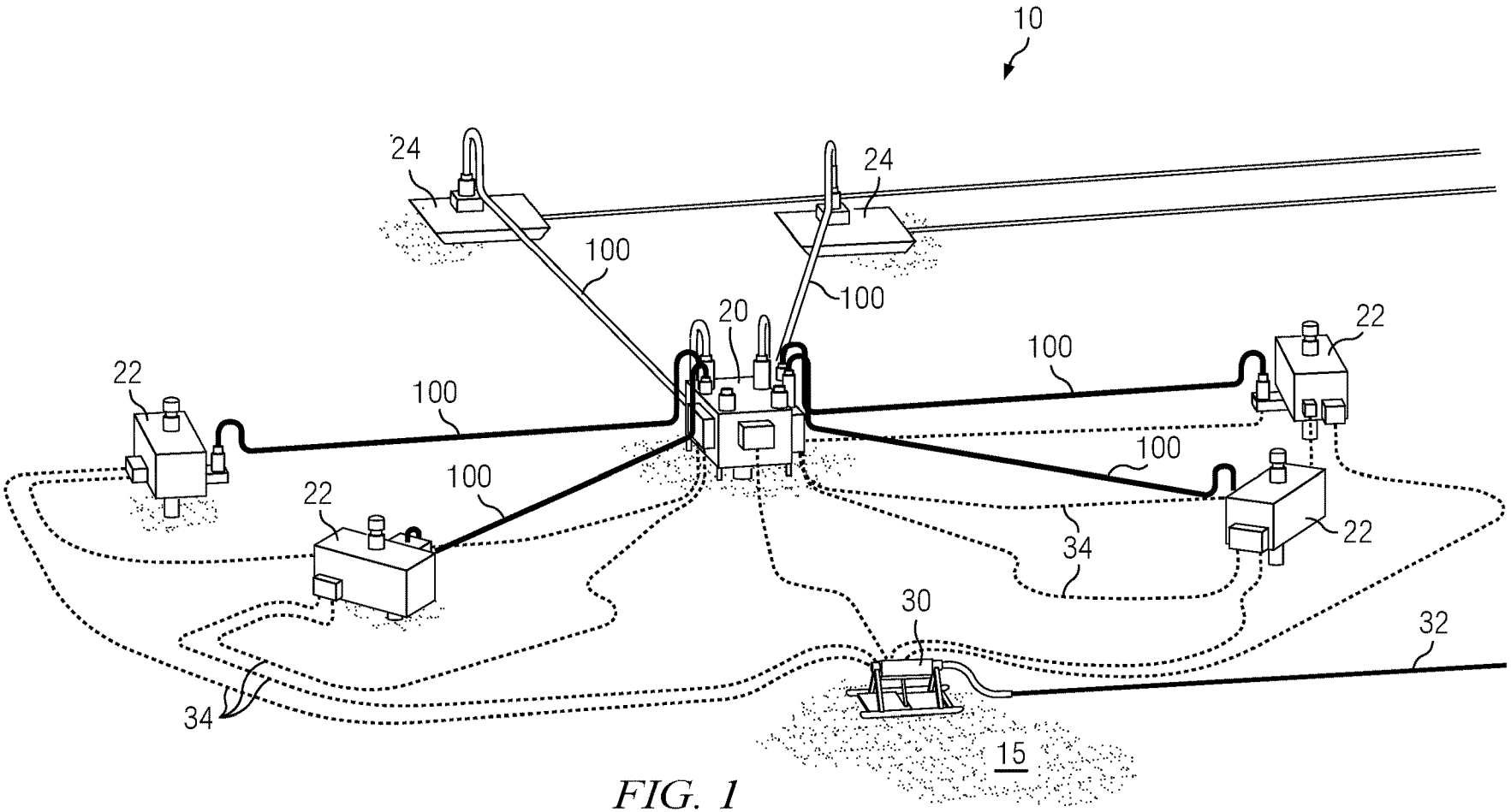
FIG. 1 depicts an example subsea production system drill center in which disclosed flowline jumper embodiments may be utilized.

FIG. 1 depicts an example subsea production system 10 (commonly referred to in the industry as a drill center) suitable for using various method and flowline jumper embodiments disclosed herein. The system 10 may include a subsea manifold 20 deployed on the sea floor 15 in proximity to one or more subsea trees 22 (also referred to in the art as Christmas trees). As is known to those of ordinary skill each of the trees 22 is generally deployed above a corresponding subterranean well (not shown). In the depicted embodiment, fluid communication is provided between each of the trees 22 and the manifold 20 via a flowline jumper 100 (commonly referred to in the industry as a well jumper). The manifold 20 may also be in fluid communication with other subsea structures such as one or more pipe line end terminals (PLETs) 24. Each of the PLETs is intended to provide fluid communication with a corresponding pipeline 28. Fluid communication is provided between the PLETs 24 and the manifold 20 via corresponding flowline jumpers 100 (sometimes referred to in the industry as spools).

FIG. 1 further depicts a subsea umbilical termination unit (SUTU) 30. The SUTU 30 may be in electrical and/or electronic communication with the surface via an umbilical line 32. Control lines 34 provide electrical and/or hydraulic communication between the various subsea structures 20 and 22 deployed on the sea floor 15 and the SUTU 30 (and therefore with the surface via the umbilical line 32). These control lines 34 are also sometimes referred to in the industry as jumpers. Despite the sometimes overlapping terminology, those of skill in the art will readily appreciate that the flowline jumpers 100 (referred to in the industry as spools, flowline jumpers, and well jumpers) and the control lines 34 (sometimes referred to in the industry as jumpers) are distinct structures having distinct functions (as described above). The disclosed embodiments are related to flowline jumpers (e.g., flowline jumpers 100).

It will be appreciated that the disclosed embodiments are not limited merely to the subsea production system configuration depicted on FIG. 1. As is known to those of ordinary skill in the art, numerous subsea configurations are known in the industry, with individual fields commonly employing custom configurations having substantially any number of interconnected subsea structures. Notwithstanding, fluid communication is commonly provided between various subsea structures (either directly or indirectly via a manifold) using flowline jumpers. The disclosed flowline jumper embodiments may be employed in substantially any suitable subsea operation in which flowline jumpers are deployed.

As described in more detail below with respect to FIGS. 2-5, at least one of the jumpers 100 shown in FIG. 1 includes one or more vibration and/or load sensors deployed thereon. The sensors may be in hardwired or wireless communication with the subsea structures to which the jumpers 100 are connected (e.g., with the manifold 20 or the tree 22, in FIG. 1) as well as with the SUTU 30 and the surface via control lines 34 and umbilical line 32.

Figure 2:
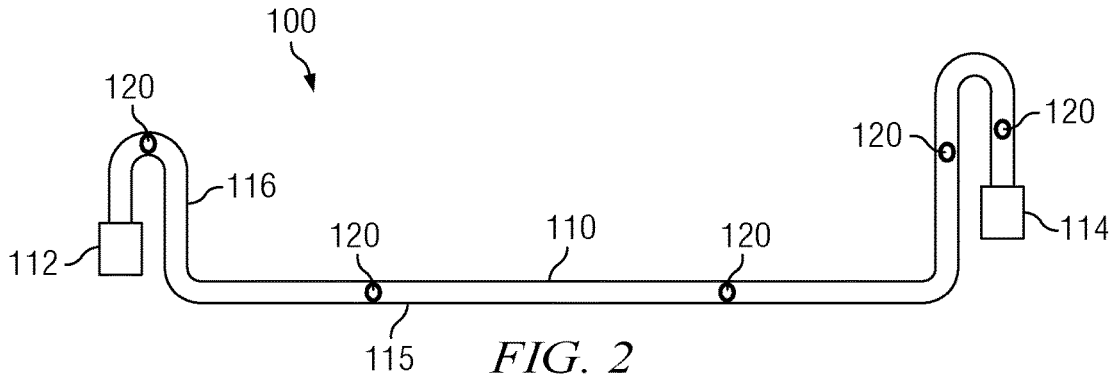
FIG. 2 depicts one example flowline jumper embodiment.

FIG. 2 schematically depicts one example flowline jumper embodiment 100 deployed between first and second subsea structures (e.g., between a tree and a manifold or between a PLET and a manifold as described above with respect to FIG. 1). In the depicted embodiment, the jumper includes a conduit (e.g., a length of cylindrical pipe) 110 deployed between first and second connectors 112 and 114. The conduit 110 may include substantially any suitable flowline jumper conduit. While rigid conduit is often preferred, the conduit may be rigid or flexible. Moreover, the conduit may be substantially any suitable size. Common conduit diameters range from about 2 to about 36 inches or more and common conduit lengths may be up to or may even exceed 150 feet. The conduit 110 may include mono-bore, multi-bore, or pipe-in-pipe configurations and may further optionally include thermal insulation. The disclosed embodiments are not limited in regards to the specific conduit configuration.

Flowline jumper connectors 112 and 114 are commonly configured for vertical tie-in and may include substantially any suitable connector configuration, for example, clamp style or collet style connectors configured to mate with corresponding hubs on the subsea equipment. While the connectors are commonly oriented vertically downward (e.g., as depicted) to facilitate jumper installation with vertically oriented hubs, it will be understood that the disclosed embodiments are not limited in this regard. Horizontal tie in techniques are also known in the art and are common in larger bore connections. Moreover, it will be further understood that the conduit 110 and connectors 112 and 114 do not necessarily lie in a single vertically oriented plane (as in the M-shaped conduit 110 in the depicted embodiment). The conduit may be shaped in substantially any two- or three-dimensional configuration suitable for providing fluid communication between subsea structures.

With continued reference to FIG. 2, jumper embodiment 100 further includes at least one vibration sensor and/or at least one load sensor (the sensors are collectively notated as sensors 120) deployed on the conduit 110. The sensor(s) may be deployed at substantially any suitable location(s) along the length of the conduit, for example, along horizontal or vertical sections of the conduit as depicted at 115 and 116. In certain embodiments, the sensor(s) 120 may be deployed in close proximity to welded joints (not shown) between adjacent conduit sections. The sensor(s) 120 may also be deployed in close proximity to one or both of the connectors 112 and 114 so as to be in sensory range of vibrations and/or loads in the connectors.

The sensor(s) 120 may include substantially any suitable sensor types. For example, in one embodiment, a vibration sensor 120 may include an accelerometer, such as a triaxial accelerometer set coupled to an outer surface of the conduit 110. Suitable triaxial accelerometers are commercially available from Honeywell and Japan Aviation Electronics Industry, Ltd. Suitable accelerometers may also include micro-electro-mechanical systems (MEMS) solid-state accelerometers, available, for example, from Analog Devices, Inc. MEMS accelerometers may be advantageous in certain applications in that they tend to be shock resistant and capable of operating over a wide range of temperatures and pressures. In another embodiment a load sensor 120 may include one or more strain gauges, for example, coupled to an outer surface of the conduit 110. Strain gauges are available from Omega Engineering.

The vibrational and/or load sensors 120 may be deployed to detect various vibrational and/or load components (or modes) in the conduit. Triaxial accelerometers may be deployed such that they are sensitive to both axial and cross-axial vibrations in the jumper conduit 110. For example, a first sensor axis may be aligned with the conduit axis, a second sensor axis may be perpendicular to the conduit axis and parallel with the jumper plane, and a third sensor axis may be perpendicular with both the conduit axis and the jumper plane. Likewise, in another example, strain gauges may be deployed such that the strain gauge axis is parallel with the axis of the conduit (such that the strain gauge is sensitive to loads along the axis of the conduit) and/or perpendicular with the axis of the conduit (such that the strain gauge is sensitive to cross axial loads, e.g., bending loads that are oriented perpendicular to the length of the conduit).

It will be appreciated that vibration sensor(s) 120 (such as accelerometers) may be employed to monitor the accelerations (and therefore the movement) of the jumper conduit. As is known to those of ordinary skill in the art, flowline jumpers are subject to both flow induced vibrations (FIV) from the flow of production fluid in the flowline jumper and vortex induced vibrations (VIV) from ocean currents external to the flowline jumper. Such FIV and VIV can be significant and over prolonged times may lead to fatigue and failure of the flowline jumper connections and welded joints. Sensor packages employing cross-axial (transverse) accelerometers may enable FIV and VIV conditions to be detected and quantified. Real time monitoring of these conditions along the flowline jumper conduit may be used to estimate the mechanical fatigue in the jumper (e.g., at a welded joint or at the connection) to provide a more accurate estimate of the useful life of the riser sections. Such measurements may improve safety while at the same time providing cost savings by eliminating overly conservative estimates that are sometimes made in the absence any measurements.

It will be further appreciated that load sensor(s) 120 (such as strain gauges) may be utilized to monitor absolute loads in the flowline jumper conduit and connectors. As is known to those of ordinary skill in the art, flowline jumpers may be subject to large static loads, for example, due to thermal expansion of casing and pipeline components. By monitoring these loads during a production operation, the corresponding movement of the flowline jumper, the overall shape change induced, and the changes in the angles between the conduit and connectors may be calculated. This information may be used to evaluate the integrity of the flowline jumper.

Figure 3:
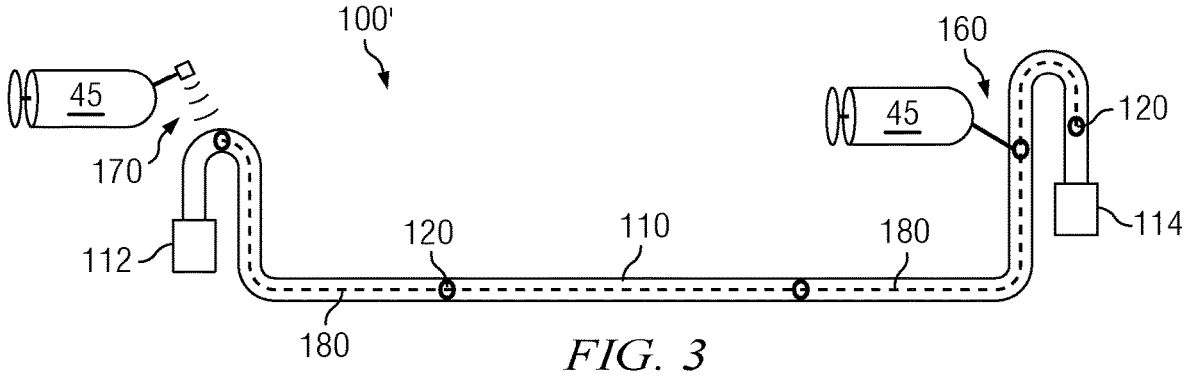
FIG. 3 depicts one example flowline jumper embodiment in communication with an ROV, an AUV, or other mobile vehicle.

FIG. 3 depicts one example flowline jumper embodiment 100' in which the sensors 120 are in communication with a remotely operated vehicle (ROV) 45 (also commonly referred to in the industry as an autonomous underwater vehicle—AUV). As depicted, the sensors 120 may be configured to communicate with the ROV via a wired connection with a receiver on the ROV (e.g., as depicted at 160) or via a wireless connection with the ROV (e.g., as depicted at 170). The jumper 100' may optionally include a wired communication link 180 providing electronic communication between the sensors such that sensor data from a plurality of sensors may be transmitted to the ROV via connection with a single sensor.

Figure 4:
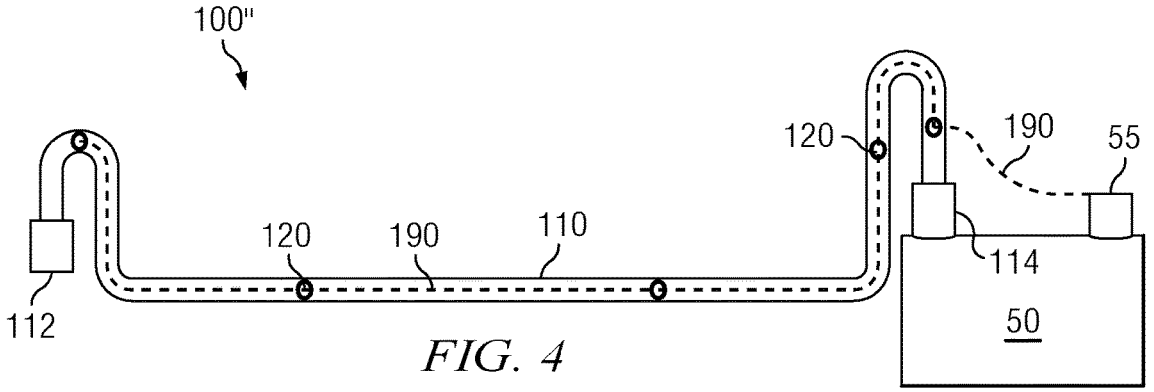
FIG. 4 depicts one example flowline jumper embodiment in communication with a host structure communication system.

FIG. 4 depicts an example flowline jumper embodiment 100" in communication with a host structure communication system (e.g., a communication system mounted on a manifold 20 or a tree 22). In the depicted embodiment, a wired communication link 190 provides electronic communication between the sensors and a communication system 55 on the host structure 50 such that sensor measurements may be transmitted from the respective sensor(s) 120 to the communication system. The sensor measurements may then be further transmitted to the surface, for example, via one of the control lines 34 and the umbilical 32 (FIG. 1).

With continued reference to FIGS. 2-4 electrical power may be provided to the sensors 20 via substantially any suitable power source. For example, individual sensor packages may be fitted with one or more batteries. Electrical power may alternatively and/or additionally be transmitted to the sensors 20 from the host structure via the hard wired communication link 190. The disclosed embodiments are explicitly not limited in these regards.

Figure 5:
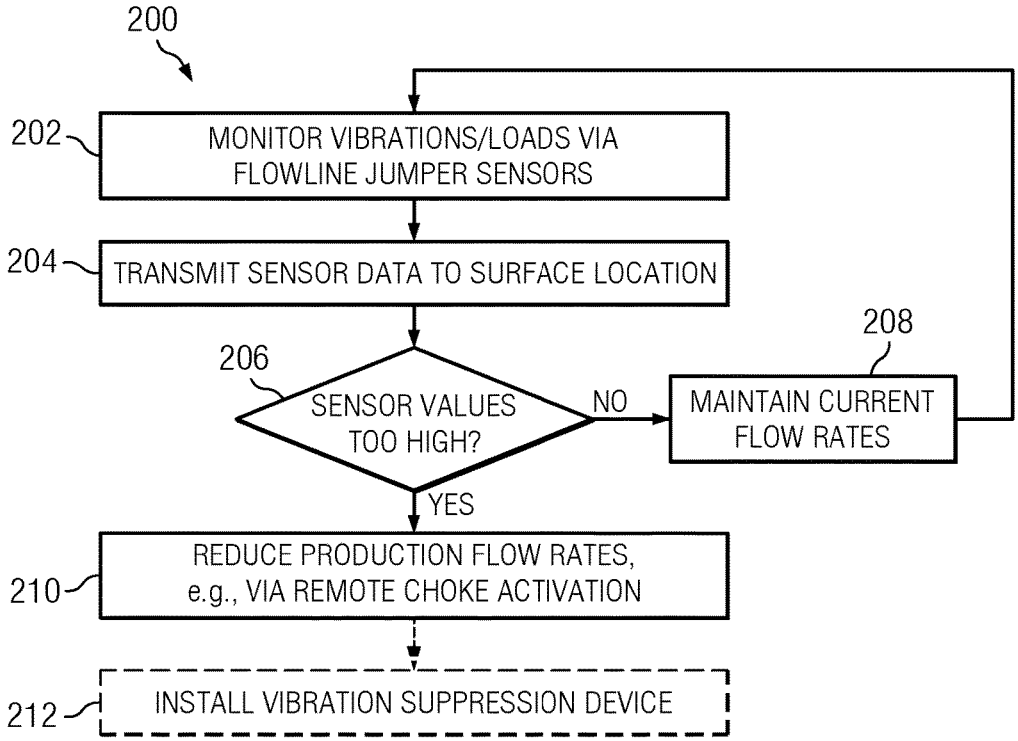
FIG. 5 depicts a flow chart of one example method embodiment.

FIG. 5 depicts a flow chart of one example method embodiment 200, for example, for producing hydrocarbon fluid from an offshore well. Production fluids are pumped or otherwise produced through the flowline jumper, for example, from a tree deployed above a well through a flowline jumper to a manifold. Vibrations and/or loads may be monitored via sensors deployed on the flowline jumper (e.g., jumper 100, 100', and 100") during installation or during a production operation at 202. The sensor measurements acquired at 202 may be transmitted to the surface (e.g., to a surface ship or to an onshore base) at 204. For example, the sensor measurements may be transmitted to a surface ship via communication link 190, control line 34, and umbilical 32 (FIGS. 1 and 4). The sensor measurements may then optionally be further transmitted to substantially any other location via satellite communication. The vibrations and/or loads may be evaluated against predetermined limits at 206. Production may continue at 208, for example, when the measured vibrations and/or loads are within the predetermined limits. The production flow rate may be reduced at 210 (e.g., via remote control of a choke deployed on a manifold 20 or tree 22) when the vibrations and/or loads exceed the predetermined limits. A vibration suppression device may also be optionally installed at 212, for example, when the measured vibrations exceed the predetermined limits.

Figure 6:
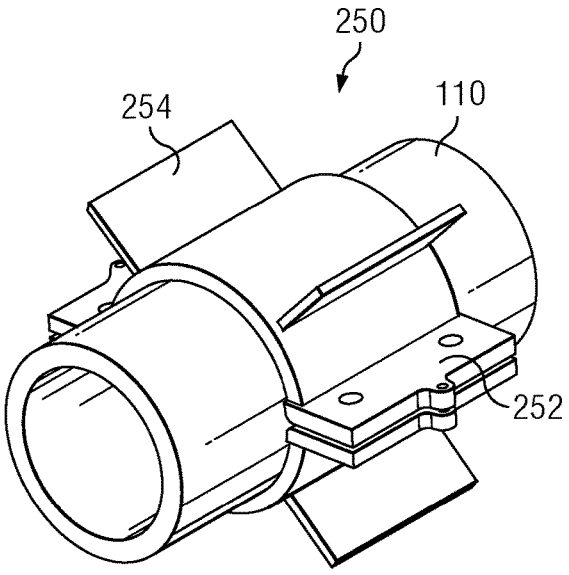
FIG. 6 depicts one example of a vibration suppression device.

FIG. 6 depicts one example of a suitable vibration suppression device 250 that may be installed at 212 of FIG. 5. In the depicted embodiment, the vibration suppression device 250 is clamped at 252 about the jumper conduit 110. The device 250 includes a plurality of axial plates 254 (or fins) that are parallel with the conduit axis. It will be understood that the plates may alternatively spiral around the jumper conduit 110. The plates increase the surface area of the conduit to which the device is attached and therefore increase the hydrodynamic added mass of the flowline jumper when it is submerged in seawater. This increased hydrodynamic added mass is intended to dampen FIV and VIV during a production operation.

Additional disclosed embodiments include a two-stage landing cylinder for landing subsea structures at the sea floor. During installation of such structures, there is generally a need for a controlled velocity landing that controls the deceleration of the structure as it approaches its final position. Single stage water dampers are known and commonly used during such installations. However, there is a need for a two-step landing system to provide better control (or even manual control in the second stage).

Figure 7:
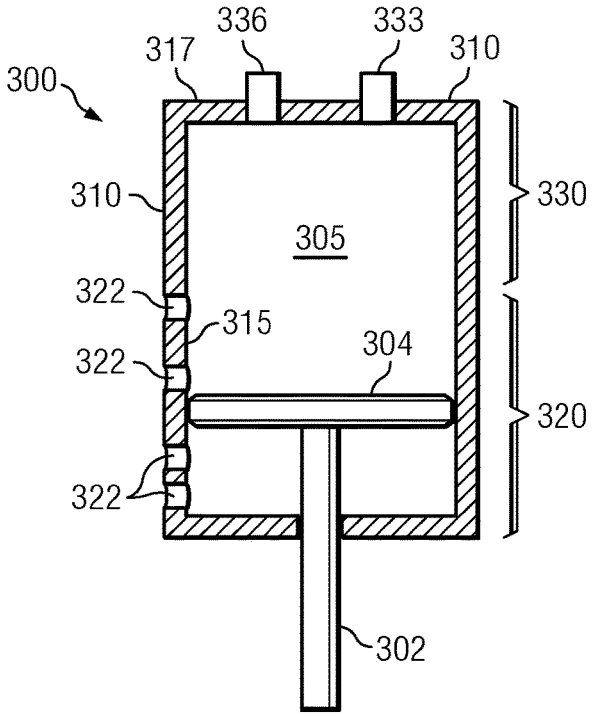
FIG. 7 depicts one embodiment of a two-stage soft stage landing system.

FIG. 7 depicts one disclosed embodiment of a two-stage soft stage landing system 300 in which the first and second stages are combined into a single cylinder. The system includes a rod 302 and piston 304 deployed in a housing 310 (e.g., a cylindrical housing). The housing 310 includes lower and upper sections 320 and 330. The lower section 320 of the housing 310 includes a plurality of through holes 322 in the sidewall 315 of the housing 310 through which seawater may be transported in and out of the pressure chamber 305. The upper section 330 of the housing is hole free (in other words the sidewall 315 in the upper section 330 includes no holes). A top surface 317 of the upper section 330 of the housing 310 includes first and second valves 333 and 336 deployed therein. The first valve 333 may be a controllable restriction valve (e.g., controllable by an ROV) while the second valve 336 may be one-way valve (such as a check valve) that permits flow into the housing but prevents flow out of the housing.

During a landing operation, the lowering velocity (the velocity of the structure being lowered) is initially determined by the number and diameter of the through holes 322 located above the piston 304 (in the pressure chamber). As the structure is lowered and the piston 304 moves upwards in the housing 310, the number of through holes decreases and the structure decelerates. Thus the lowering velocity in the first stage is initially relatively high and then decreases as the number of holes in the pressure chamber decreases. The velocity and deceleration of the piston may thus be determined, in part, by the distribution of the through holes 322 and may be derived mathematically, for example, as follows:

The differential pressure p across the cylinder (housing) wall may be given as follows:

$$p = \frac{m_{wet} \cdot g}{A} p_{ambient}$$

where $m_{wet}$ represents the wet weight of the structure being installed, g represents gravitational acceleration, A represents the cross sectional area of the piston, and $p_{ambient}$ represents the ambient pressure. The flow rate Q out of the housing (through the holes 322) may be given as follows:

$$Q = n \cdot \sqrt{\frac{2p \cdot A_{hole}^2}{\rho \cdot k}}$$

where n represents the number of holes located above the cylinder (in the pressure chamber), $A_{hole}$ represents the cross sectional area of each of the holes, ρ represents fluid density, and k represents a pressure loss factor for the hole. The lowering velocity v may be given as follows:

$$v = \frac{4Q}{\pi \cdot d^2}$$

where d represents the cylinder diameter and Q is as the flow rate as defined above. As the piston moves upwards in the cylinder, the number of holes n decreasing, thereby decreasing the flow rate Q and the lowering velocity v.

As stated above, there are no holes in the upper section 330 of the housing 310. A controlled landing is obtained by opening (or partially opening) valve 333, thereby allowing the remaining fluid to flow out of the chamber 305. The landing speed in the second stage may thus be controlled at substantially any suitable velocity (based on the position of the valve 333).

During retrieval of the subsea structure, there is generally a need for a rapid return of the piston which requires unrestricted flow into the chamber 305. Check valve 336 is intended to provide such unrestricted flow into the chamber (but blocks flow out of the chamber).

Although a system and method for load and vibration monitoring on a subsea flowline jumper has been described in detail, it should be understood that various changes, substitutions and alternations can be made herein without departing from the spirit and scope of the disclosure as defined by the appended claims.

The invention claimed is:

1. A flowline jumper for providing fluid communication between first and second spaced apart subsea structures, the flowline jumper comprising:

a length of conduit located at a seabed and surrounded by a body of fluid, the conduit having a predetermined size and shape to accommodate a flow of another fluid therethrough;

first and second connectors deployed on opposing ends of the conduit, the first and second connectors configured to couple with corresponding connectors on the subsea structures at a sea floor;

at least one vibration suppression device with a plurality of conduit axis aligned plates extending therefrom, the at least one vibration suppression device-clamping about an external surface of the flowline jumper and directly surrounding the plates by the body of fluid, the at least one vibration suppression device configured to facilitate dampening of a flow induced vibration from the another fluid flowing in the conduit and dampening of a flow induced vibration from the body of fluid surrounding the conduit;

at least one electronic sensor deployed on the conduit, the sensor configured to:

measure at least one of a vibration and a load in the conduit;

detect and identify each of the flow induced vibration from the another fluid flowing in the conduit and the flow induced vibration from the body of fluid surrounding the conduit; and monitor absolute loads in the conduit and the first and second connectors; and a communication link to a surface location to provide real-time monitoring of the flow induced vibration from the another fluid flowing in the conduit and the flow induced vibration from the body of fluid surrounding the conduit to estimate a mechanical fatigue of the flowline jumper;

wherein the at least one electronic sensor comprises a cross-axial accelerometer that monitors accelerations of the conduit to measure the vibration.

2. The flowline jumper of claim 1, further comprising a plurality of the electronic sensors in electronic communication with one another.

3. The flowline jumper of claim 1, wherein the at least one electronic sensor is configured to communicate electronically with a remotely operated vehicle or an autonomous underwater vehicle.

4. The flowline jumper of claim 1, wherein the at least one electronic sensor is in electronic communication with a surface control system via a subsea umbilical.

5. The flowline jumper of claim 1, wherein the at least one electronic sensor further comprises a strain gauge.

6. The flowline jumper of claim 5, wherein the strain gauge comprises at least first and second strain gauges, the first strain gauge being deployed such that its axis is parallel with an axis of the conduit and the second strain gauge being deployed such that its axis is perpendicular with the axis of the conduit.

7. The flowline jumper of claim 1, wherein the cross-axial accelerometer comprises a triaxial accelerometer having at least one axis oriented perpendicular to an axis of the conduit.

8. A subsea measurement system comprising:

a flowline jumper deployed between first and second subsea structures at a sea floor and surrounded by a body of fluid, the flowline jumper providing a fluid passageway between the first and second subsea structures to accommodate a flow of another fluid therethrough, the flowline jumper including (i) a length of rigid conduit and (ii) first and second connectors deployed on opposing ends of the conduit, the first and second connectors connected to corresponding connectors on the first and second subsea structures;

at least one vibration suppression device with a plurality of conduit axis aligned plates extending therefrom, the at least one vibration suppression device clamping about an external surface of the flowline jumper and directly surrounding the plates by the body of fluid, the at least one vibration suppression device configured to facilitate dampening of a flow induced vibration from the another fluid flowing in the conduit and dampening of a flow induced vibration from the body of fluid surrounding the conduit; and at least one electronic sensor deployed on the conduit, the sensor configured to:

measure at least one of a vibration and a load in the conduit;

detect and identify each of the flow induced vibration from the another fluid flowing in the conduit and the flow induced vibration from the body of fluid surrounding the conduit; and monitor absolute loads in the conduit and the first and second connectors; and a communication link between the at least one electronic sensor to a surface control system configured to provide real-time monitoring of the flow induced vibration from the another fluid flowing in the conduit and the flow induced vibration from the body of fluid surrounding the conduit to estimate a mechanical fatigue of the flowline jumper;

wherein the at least one electronic sensor is in electronic communication with at least one of the subsea structures; and wherein the at least one electronic sensor comprises a cross-axial accelerometer that monitors accelerations of the conduit to measure the vibration.

9. The measurement system of claim 8, further comprising a plurality of the electronic sensors deployed on the conduit, the plurality of electronic sensors in electronic communication with one another and with the surface control system.

10. The measurement system of claim 8, wherein the at least one electronic sensor further comprises a strain gauge.

11. The measurement system of claim 8, wherein the cross-axial accelerometer comprises a triaxial accelerometer having at least one axis oriented perpendicular to an axis of the conduit.

12. The measurement system of claim 10, wherein the strain gauge comprises at least first and second strain gauges, the first strain gauge being deployed such that its axis is parallel with an axis of the conduit and the second strain gauge being deployed such that its axis is perpendicular with the axis of the conduit.

13. A hydrocarbon production method, comprising:

(a) positioning a subsea flowline jumper at a sea floor and surrounded by a body of fluid, the jumper to accommodate produced wellbore fluids therethrough at a controlled flow rate, the flowline jumper providing a rigid fluid passageway for the wellbore fluids between first and second subsea structures deployed on the sea floor;

(b) causing a sensor comprising a cross-axial accelerometer deployed on the flowline jumper to monitor accelerations of the conduit and measure at least one of a vibration and a load in the flowline jumper, the sensor configured to: (i) detect and identify each of a flow induced vibration from the wellbore fluids flowing in the conduit and a flow induced vibration from the body of fluid surrounding the flow line jumper, and (ii) monitor absolute loads in the conduit;

(c) transmitting the sensor measurement made in (b) to a control system at a surface location;

(d) evaluating the sensor measurement at the surface location to provide real-time monitoring of the flow induced vibration from the wellbore fluids flowing in the conduit and the flow induced vibration from the body of fluid surrounding the flow line jumper to estimate a mechanical fatigue of the flowline jumper;

(e) maintaining the flow rate in (a) when the sensor measurement is less than a predetermined threshold; and (f) reducing the flow rate in (a) when the sensor measurement is greater than a predetermined threshold and clamping a vibration suppression device with a plurality of conduit axis aligned plates extending therefrom about an external surface of the flowline jumper to facilitate dampening of flow induced vibration from the wellbore fluids within the conduit and dampening of flow induced vibration from the body of fluid surrounding the flow line jumper.

14. The method of claim 13, wherein the sensor deployed on the flowline jumper further comprises a strain gauge.

15. The method of claim 13, wherein the cross-axial accelerometer comprises a triaxial accelerometer having at least one axis oriented perpendicular to an axis of conduit in the flowline jumper.

16. The method of claim 14, wherein the strain gauge comprises at least first and second strain gauges, the first strain gauge being deployed such that its axis is parallel with an axis of the conduit in the flowline jumper and the second strain gauge being deployed such that its axis is perpendicular with the axis of the conduit.

* * * * *